US005791418A

United States Patent [19]

Milberger et al.

[11] Patent Number: 5,791,418

[45] Date of Patent: Aug. 11, 1998

[54] TOOLS FOR SHALLOW FLOW WELLHEAD SYSTEMS

[75] Inventors: Lionel J. Milberger, Houston; Gilbert P. Mican, Sealy; David L. Ford, Katy, all of Tex.

[73] Assignee: ABB Vetco Gray Inc., Houston, Tex.

[21] Appl. No.: 646,674

[22] Filed: May 10, 1996

[51] Int. Cl.[6] ..... F21B 33/14

[52] U.S. Cl. ..... 166/368; 166/334.4

[58] Field of Search ..... 166/368, 386, 166/334.4, 332.4

[56] References Cited

U.S. PATENT DOCUMENTS

| | | | |
|---|---|---|---|
| 4,040,485 | 8/1977 | Vann et al. | 166/334.4 |
| 5,188,180 | 2/1993 | Jennings | 166/338 |
| 5,188,181 | 2/1993 | Brammer et al. | 166/368 X |

OTHER PUBLICATIONS

Brochure entitled "Baker Oil Tools Safety Systems—The Leader in Completion Technology.", Dec., 1992.

Brochure entitled "Baker Oil Tools Flow Control Systems—People and Products Providing Solutions for Completions, Workovers and Fishing", Mar., 1994.

*Primary Examiner*—William P. Neuder

*Attorney, Agent, or Firm*—James E. Bradely

[57] ABSTRACT

A tool is employed to shift an external valve sleeve on an outer wellhead housing at a subsea location. The tool has an engaging member that moves between upper and lower positions. The tool has a locking member that locks to the inner wellhead housing with the engaging member sliding over the outer wellhead housing. In one embodiment, the tool also is employed to run the inner wellhead housing and preload it. The engaging member moves to a lower position to shift the valve sleeve after the inner wellhead housing has been preloaded by the tool. In another embodiment, the tool is lowered over a previously installed inner wellhead housing to retrieve the valve sleeve for repair or replacement.

20 Claims, 7 Drawing Sheets

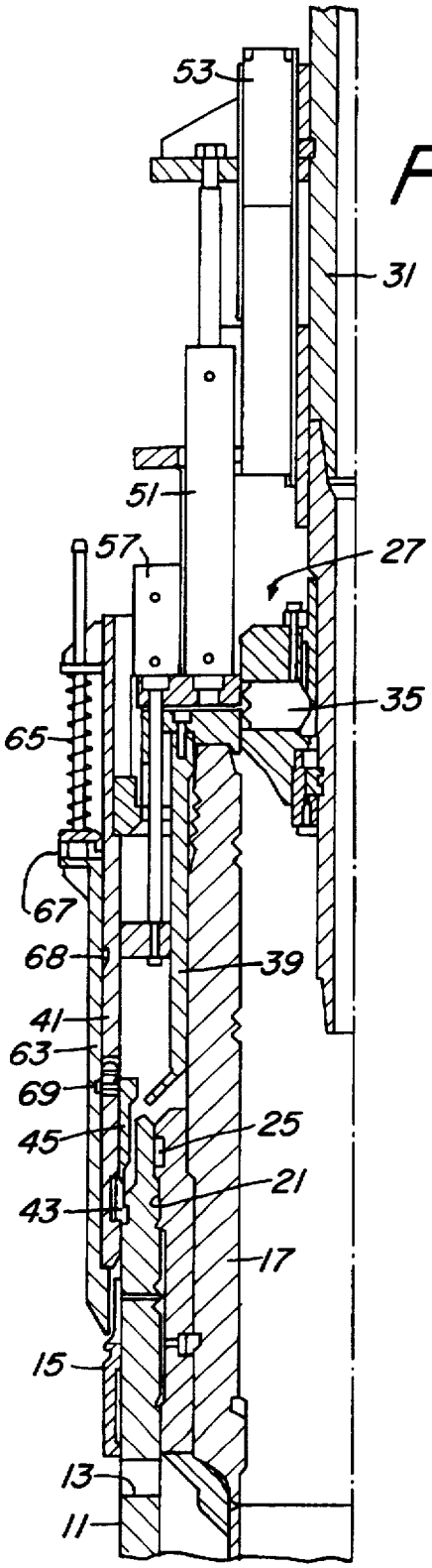
Fig. 3
Fig. 4
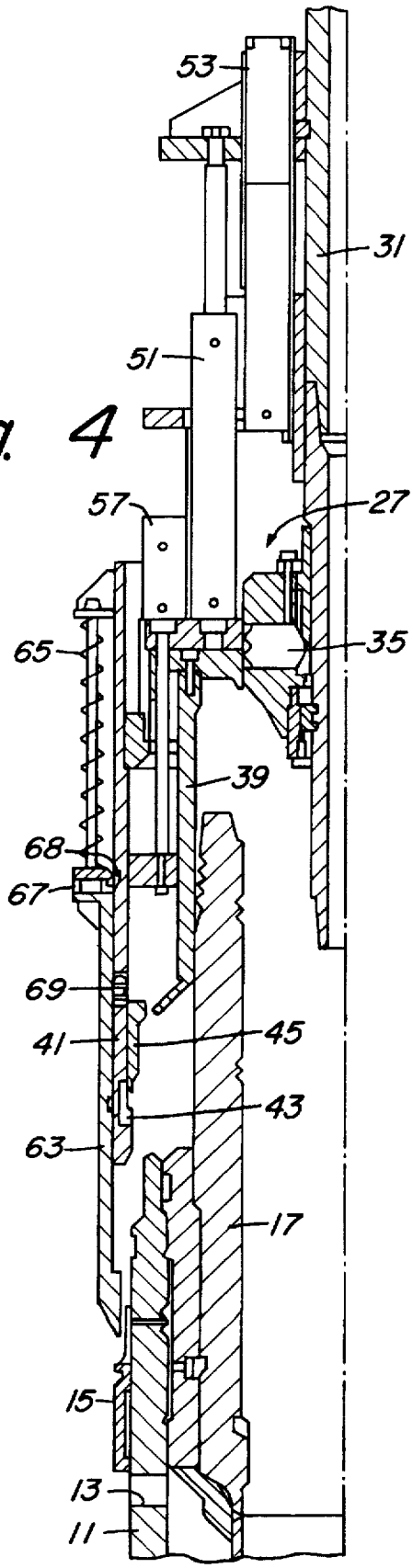

TOOLS FOR SHALLOW FLOW WELLHEAD SYSTEMS

BACKGROUND OF THE INVENTION

1. Field of the Invention

This invention relates in general to running tools for subsea wellheads, and in particular to tools employed for moving a valve sleeve for a shallow flow wellhead system.

2. Description of the Prior Art

A common offshore technique involves drilling a first section of the hole and installing conductor pipe with an external wellhead housing at the upper end. The external wellhead housing will be located approximately at the sea floor. Then, the operator drills the well to a second depth and installs a first section of casing. An internal or high pressure wellhead housing is located at the upper end of the first string of casing. This first string of casing will be cemented in the well, with cement returns flowing up around the casing, through the conductor pipe and out flow ports located in the external wellhead housing. These flow ports remain open after cementing.

The operator retrieves the running tool for the internal wellhead housing and connects a drilling riser and blowout preventer to the internal wellhead housing. The operator will then drill the well to greater depths and normally install at least two more strings of casing. Each string of casing has a casing hanger at its upper end which will land and seal in the internal wellhead housing.

In some areas, the conventional technique described above is not satisfactory. For example, one area in the Gulf of Mexico has an unconsolidated sand formation approximately 1000 below sea level. This formation has a pressure that is higher than the pressure at the sea floor by approximately 50–250 psi. When drilled into, the formation tends to wash out, with water and sand flowing upward to the sea floor. If the well washes out severely, this can be a dangerous problem.

Various techniques have been employed to overcome the washout problem. A cement is available that is of a foaming type which can be employed to retard washout. U.S. Pat. No. 5,184,686 discloses a system for avoiding washout. However, that system requires using two different size drilling risers at various stages of the drilling. This makes the technique very expensive.

In another prior art system, each of the flow ports in the external wellhead housing is connected to a ball valve which can be closed by a remote operated vehicle after the internal wellhead housing is installed. Closing the ball valves assures that if leakage from the water producing formation begins after completion of the well, it will not flow out the flow ports, causing a dangerous washout. However, it is advantageous to have several flow ports to allow a high flow rate while the flow ports are open. Several ball valves add substantially to the expense of a completed well and to operating difficulties.

SUMMARY OF THE INVENTION

In this invention, the subsea wellhead includes an outer or external wellhead housing and inner or internal wellhead housing. Flow ports exist in the external wellhead housing for flow of returns. An external sleeve is mounted to the external wellhead housing. The sleeve is axially moveable between an open and a closed position.

The tool of this invention has an engaging member that slides over the outer wellhead housing. It has a locking member that locates within the interior of the inner wellhead housing and secures the tool to the inner wellhead housing. Means are employed to move the engaging member downward into contact with the sleeve and move it to a lower position.

In one embodiment, the tool both shifts the valve sleeve as well as runs the inner wellhead housing. The locking member secures the running tool to the inner wellhead housing at the drilling rig. The engaging member will be located in an upper position. The running tool has hydraulic means to force the inner wellhead housing downward into a preloaded engagement with the outer wellhead housing. After preloading, the engaging member is positioned at a lower position by picking up the running tool relative to the inner wellhead housing and engaging member. Then, a latch locks the engaging member in the lower position, and the string is lowered again. The engaging member contacts the valve sleeve and pushes it to the closed position.

Another embodiment of the invention is a valve sleeve retrieval tool that also can run a valve sleeve from the surface onto an existing subsea wellhead assembly. The retrieval tool is lowered from the surface and has a funnel that slides over the inner wellhead housing, which has been previously installed. The retrieval tool has an engaging member that is stroked downward. A latch in the retrieval tool will latch into engagement with the valve sleeve. Picking up the tool pulls the valve sleeve from the outer wellhead housing and retrieves it to the surface for repair or replacement. The same tool can reinstall the valve sleeve and move it to the closed position.

BRIEF DESCRIPTION OF THE DRAWINGS

FIG. 3 is a quarter sectional view of the running tool of FIG. 1, shown applying a preload force to the inner wellhead housing.

FIG. 4 is a quarter sectional view of the running tool of FIG. 1, shown moving the running tool upward relative to the engaging member after the preload force has been applied.

DETAILED DESCRIPTION OF THE PREFERRED EMBODIMENT

Figure 1:
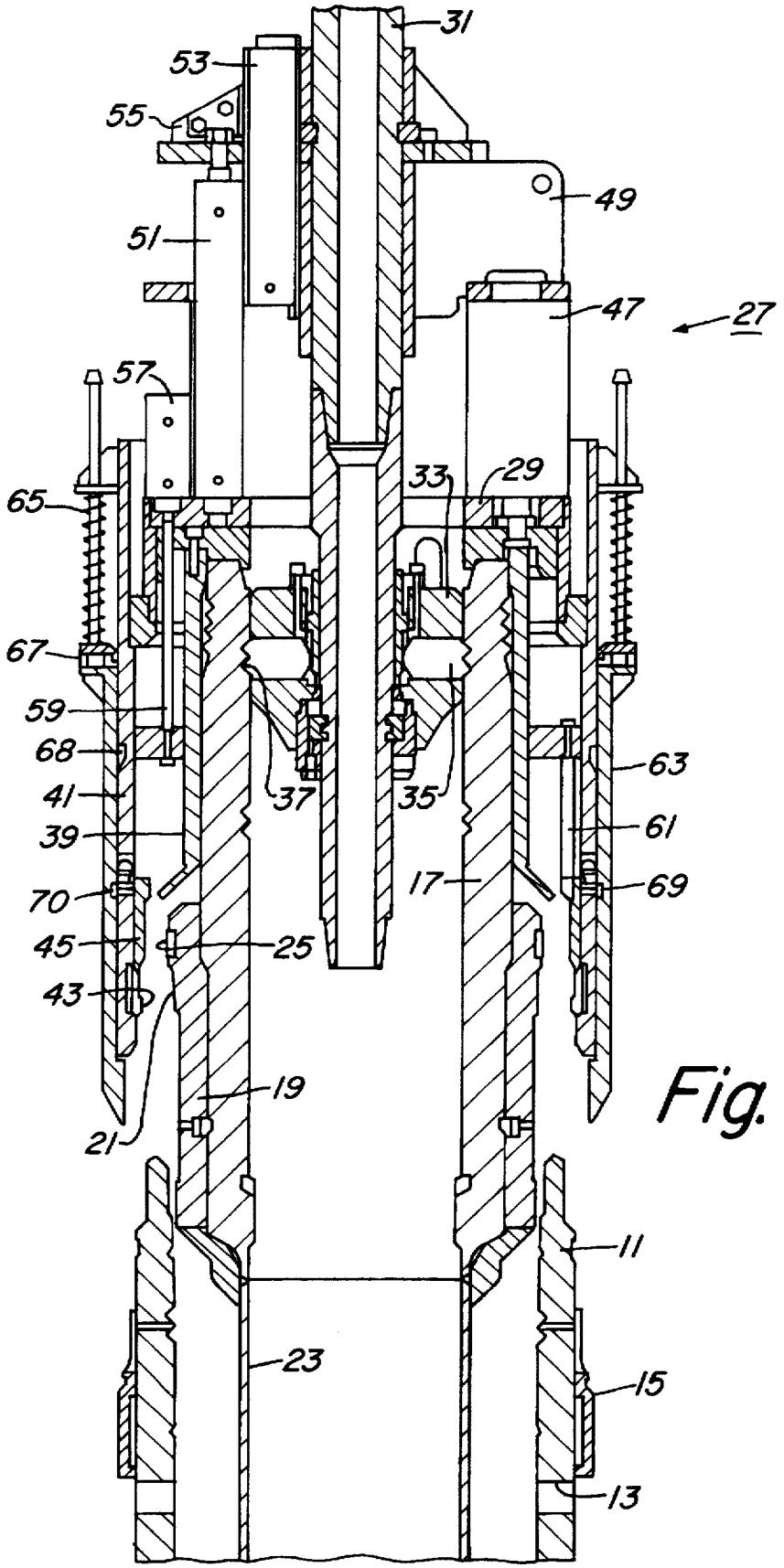
FIG. 1 is a sectional view of a running tool installing an inner wellhead housing in an outer wellhead housing in accordance with this invention.

Referring to FIG. 1, outer wellhead housing 11 is located at the sea floor and is connected to a string of conductor pipe (not shown) which extends into the well to a first depth. Outer wellhead housing 11 has a plurality of ports 13 extending through its sidewall. Outer wellhead housing 11 is particularly to be used in conditions where shallow sands tend to flow, such as in the Gulf of Mexico. An external valve sleeve 15 is mounted to the exterior of outer wellhead housing 11 for movement from an upper open position shown in FIG. 1 downward to the closed position shown in FIG. 5 to block any further flow out flow ports 13.

Valve sleeve 15 is a cylindrical ring which will move relative to the longitudinal axis of outer wellhead housing 11. As shown in FIG. 2B, valve sleeve 15 has an upward extending neck 16 and a locking groove 18 located below the base of neck 16. Valve sleeve 15 has seals 20 that sealingly engage the exterior of outer wellhead housing 11.

An inner wellhead housing 17 is shown being installed within outer wellhead housing 11. Inner wellhead housing 17 is a high pressure member which is inserted into the bore of outer wellhead housing 11 and protrudes above. Subsequently, casing will be landed within inner wellhead housing 17 on casing hangers (not shown). Inner wellhead housing 17 has a landing sleeve 19 mounted to it which has two exterior conical wedge surfaces 21. Wedge surfaces 21 will wedge tightly into mating surfaces formed in the bore of outer wellhead housing 11 with sufficient downward force applied to inner wellhead housing 17.

Figure 5:
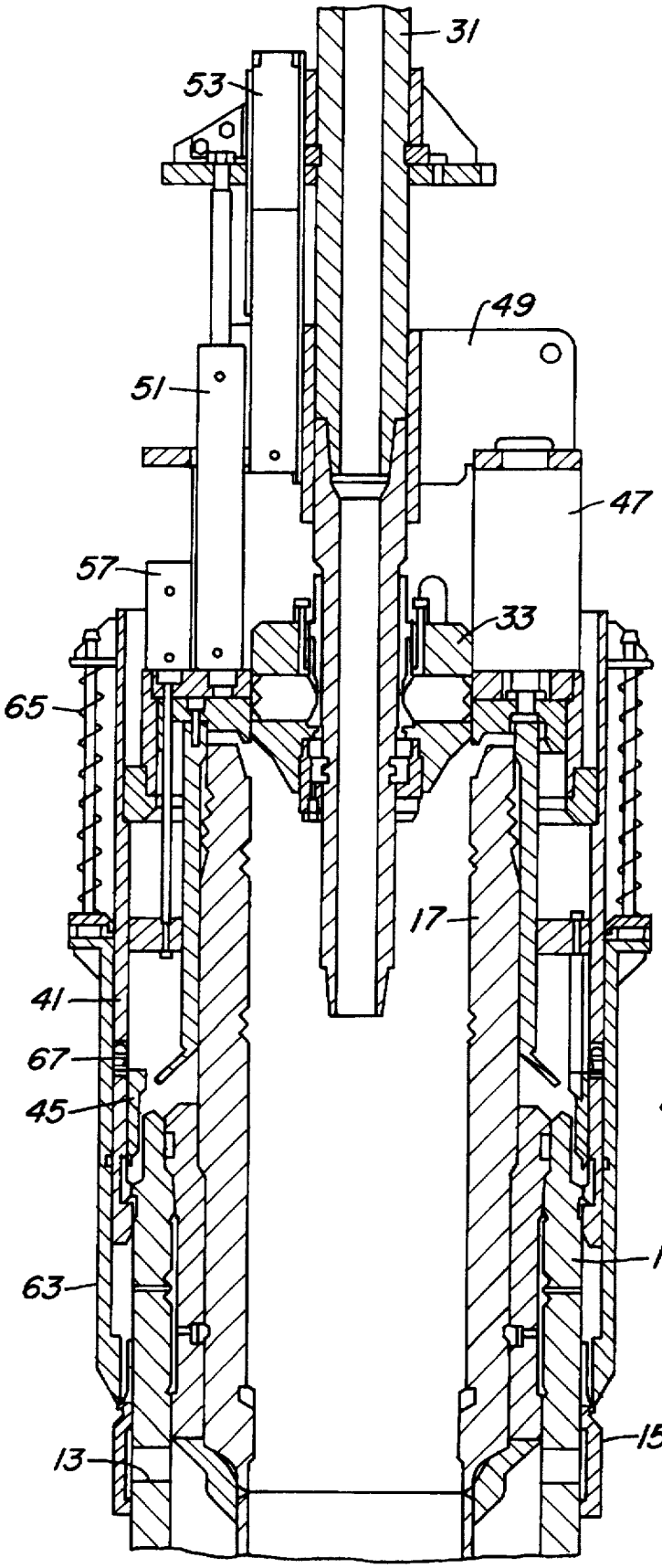
FIG. 5 is a sectional view of the running tool of FIG. 1, shown moving the valve sleeve downward with the running tool.
Figure 6A:
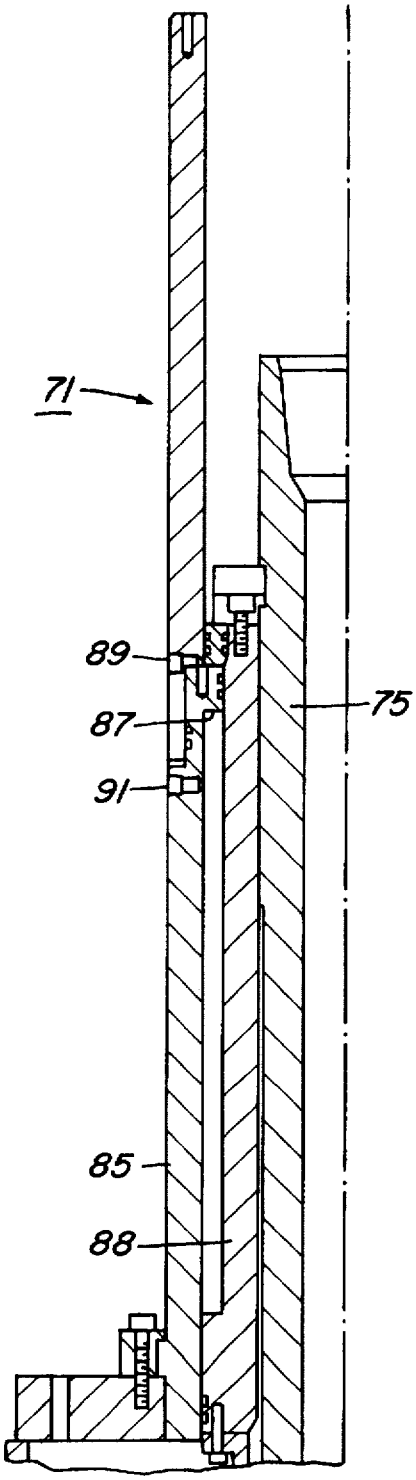
FIGS. 6A, 6B are a sectional view of a retrieval tool in accordance with this invention for running and retrieving the valve sleeve.
Figure 6B:
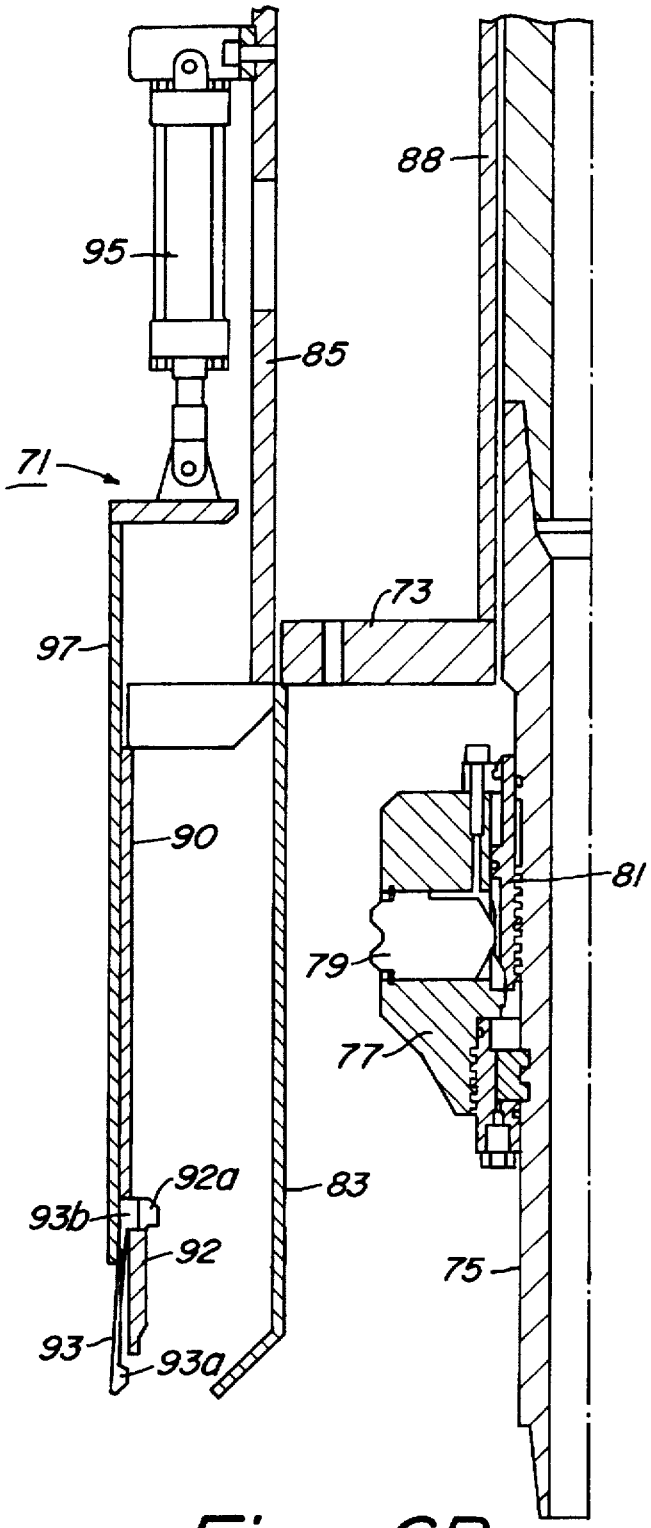

Inner wellhead housing 17 is shown attached to a first string of casing 23 that has been lowered into the well and which will subsequently be cemented in place. A latch 25 is located on landing sleeve 19 for engaging a mating profile in the bore of outer wellhead housing 11. FIG. 5 shows inner wellhead housing 17 installed within outer wellhead housing 11.

A running tool 27 is used to run inner wellhead housing 17 and to force wedge surfaces 21 into a selected preloaded engagement. Running tool 27 also is employed to shift valve sleeve 15 to the closed position. Running tool 27 includes a a plate or body 29 that rests on top of inner wellhead housing 17. Body 29 is rigidly mounted to a stem 31 that extends upward and is secured to a string of drill pipe (not shown). An inner locking or support member 33 is carried by stem 31 for releasably securing running tool 27 to inner wellhead housing 17. Locking member 33 has a plurality of dogs 35 that are forced outward into engagement with a mating grooved profile 37 in the bore of inner wellhead housing 17. Dogs 35 are moved outward and retracted to an inner position by rotating the drill string and stem 31 relative to body 33. An antirotation key (not shown) on locking member 33 engages a slot in inner wellhead housing 17 to prevent rotation of locking member 33 relative to inner wellhead housing 17.

Running tool 27 also has a funnel 39 that slides around the inner wellhead housing 17. A larger diameter reacting sleeve 41 is located outward of funnel 39. Reacting sleeve 41 is a cylinder that is carried by body 29 and is capable of axial movement relative to body 29. Reacting sleeve 41 has a latch or split ring 43 that will engage a grooved profile on the exterior of outer wellhead housing 11. Split ring 43 can be released from engagement by downward movement of a release cam 45. Release cam 45 is a ring carried on the inner diameter of reacting sleeve 41. When split ring 43 has engaged outer wellhead housing 11, a downward force can be applied on inner wellhead housing 17, with the force being reacted through reacting sleeve 41 to outer wellhead housing 11.

The means to cause the preload engagement includes a plurality of preload cylinders 47 (only one shown). Preload cylinders 47 are hydraulic cylinders connected between body 29 and a frame 49 which slides axially relative to stem 31 and body 29. The hydraulic system also includes a pair of pump cylinders 51, 53. Pump cylinders 51, 53 are connected between body 29 and a stem clamp 55 which is rigidly clamped to stem 31 above frame 49. Moving stem 31 upward will cause hydraulic cylinders 51, 53 to pump hydraulic fluid to preload cylinders 47 to push downward on inner wellhead housing 17. There also are a plurality of release cylinders 57 (only one shown) which are connected through rods 59, 61 to release cam 45. Release cylinders 57 are mounted to body 29. When actuated, release cylinders 57 will move release cam 45 downward to release split ring 43.

Running tool 27 up to this point is constructed as disclosed in more detail in U.S. Pat. No. 5,188,180, Feb. 23, 1993, all of which material hereby incorporated by reference. New structure includes an engaging member or sleeve 63 which is mounted to the exterior of reacting sleeve 41. Engaging sleeve 63 will slide axially relative to reacting sleeve 41 as well as to body 29. Engaging sleeve 63 has an upper position relative to reacting sleeve 41, which is shown in FIG. 1. Engaging sleeve 63 also has a lower position relative to reacting sleeve 41, which is shown in FIG. 5. A plurality of coil springs 65 urge engaging sleeve 63 downward. Springs 65 are retained by rods and secured to an upper portion of reacting sleeve 41.

Figure 2A:
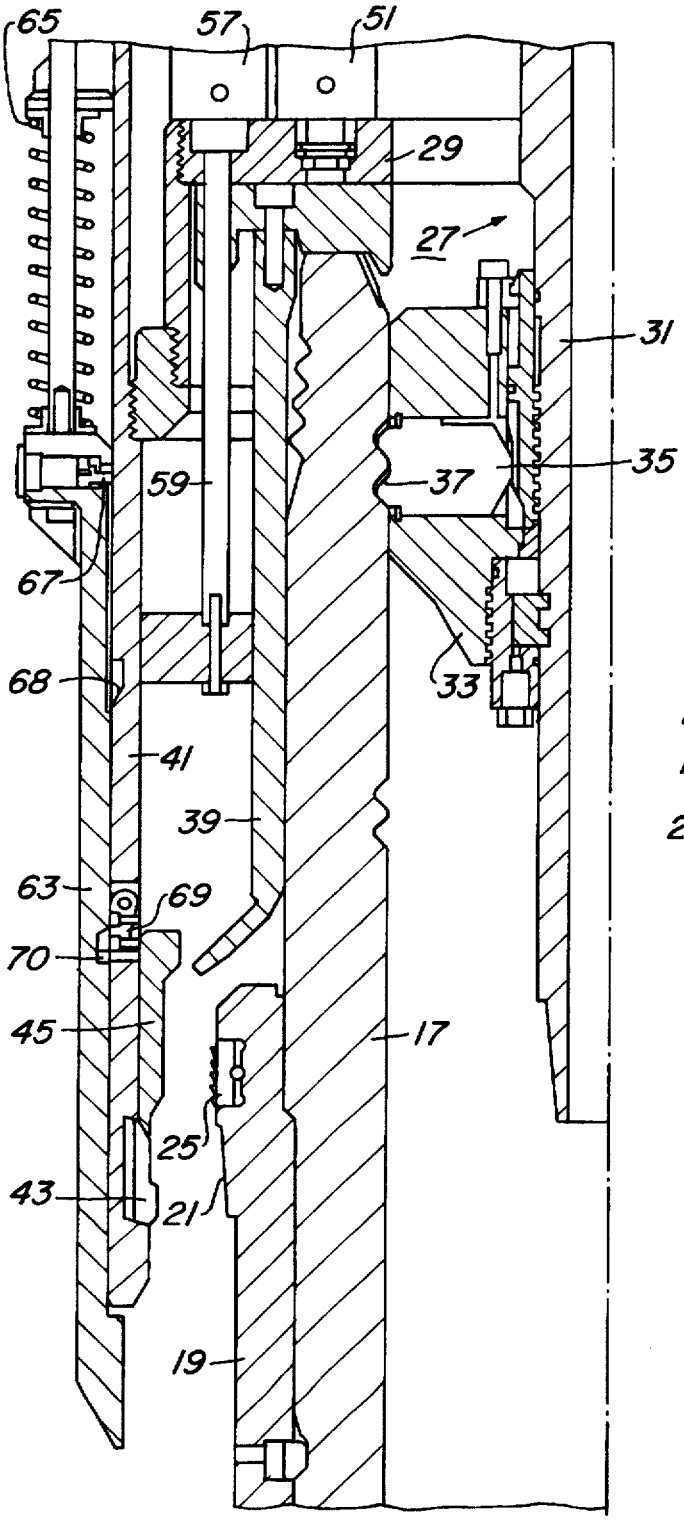
FIGS. 2A, 2B are an enlarged partial sectional view of a portion of the running tool of FIG. 1.
Figure 2B:
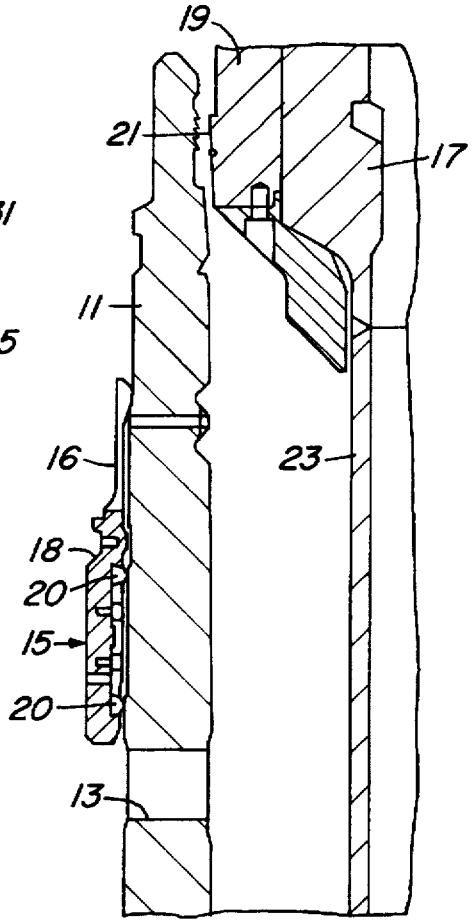

As shown also in FIG. 2A, a plurality of upper latches 67 are mounted near the upper end of engaging sleeve 63. Upper latches 67 are spring-biased pins which are urged radially inward. When engaging sleeve 63 is forced to move to a lower position relative to reacting sleeve 41, upper latches 67 will snap into a groove 68 formed on the exterior of reacting sleeve 41. This results in engaging sleeve 63 being locked in the lower position relative to reacting sleeve 41.

A plurality of lower latches 69 are mounted to reacting sleeve 41 for engaging a groove 70 formed in the interior of engaging sleeve 63. When lower latches 69 are engaged, as shown in FIG. 1, they will hold engaging sleeve 63 in the upper position relative to reacting sleeve 41, with springs 65 being compressed. Latches 69 are maintained in engagement with groove 70 by overlapping engagement of release cam 45. When release cam 45 is stroked downward to release split ring 43, it frees lower latches 69 to release from engagement with groove 70, allowing springs 65 to push engaging sleeve 63 downward.

In the operation of the running tool, a string of casing 23 will be made up to inner wellhead housing 17 at the rig floor. Running tool 27 will be secured to inner wellhead housing 17 as shown in FIG. 1 by rotating stem 31 to push dogs 35 into engagement with profile 37. Reacting sleeve 41 will be held in an upper position as well as engaging sleeve 63. The entire assembly is then lowered into the sea. Inner wellhead housing 17 will initially land in outer wellhead housing 11 with wedge surfaces 21 engaging mating profile surfaces in the bore of outer wellhead housing 11. FIG. 1 shows inner wellhead housing 17 entering outer wellhead housing 11. Latch 25 will snap into the profile in outer wellhead housing 11, as shown in FIG. 3. This is an initial landing position, as inner wellhead housing 17 is not yet preloaded in the wellhead housing 11. At this point, the lower end of engaging sleeve 63 will not be engaging sleeve valve 15, which will remain in the upper open position.

At this time, the operator can cement casing 23, then preload the inner wellhead housing 17 into outer wellhead housing 11, but preferably, the preloading occurs before cementing. To preload, the operator must first release locking member 33. This is handled by rotating stem 31, causing dogs 35 to retract from profile 37. Then, the operator picks up the drill string, as shown in FIG. 3. Locking member 33 will move upward, but reacting sleeve 41 will remain in place because of split ring 43. Because of stem clamp 55, pump cylinders 51 will begin to stroke, pumping hydraulic fluid into preload cylinders 47 (FIG. 1). This forces inner wellhead housing 17 downward into preloaded engagement with outer wellhead housing 11. This is the position shown in FIG. 3.

Then, the operator slacks off on the drill string a selected amount and picks up again to shift a valve (not shown) in the hydraulic system, as explained in U.S. Pat. No. 5,188,380. After the hydraulic valve shifts, the operator again picks up the drill string. Now, the hydraulic fluid being pumped by pump cylinders 51, 53 is delivered to release cylinder 57. This drives release cam 45 downward to retract split ring 43. Because of the downward movement of release cam 45, lower latches 69 release from groove 70, and springs 65 force engaging sleeve 63 downward as shown in FIG. 4. Then, the operator picks up again until body 29 is about 12 inches above the rim of inner wellhead housing 17. At this point, upper latches 67 will snap into groove 68, locking engaging sleeve 63 in the extended or lower position as shown in FIG. 4.

The operator then lowers the drill pipe, with engaging sleeve 63 moving downward in unison with reacting sleeve 41 and body 29. The lower end of engaging sleeve 63 will contact valve sleeve 15 and push it to the closed position as shown in FIG. 5. The operator then is free to retrieve running tool 27, which is free of any engagement with the subsea structure at this point.

Figure 7:
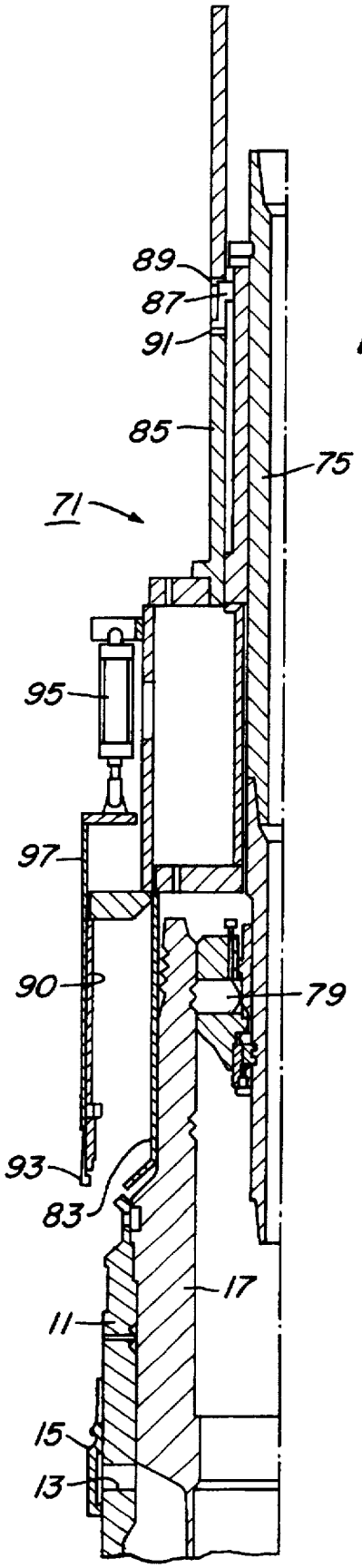
FIG. 7 is a quarter sectional view of the retrieval tool of FIG. 6, shown engaging the inner wellhead housing.

FIGS. 6–10 illustrate a valve sleeve retrieval tool 71 which can also be used to install the valve sleeve 15, however, cannot be employed for running inner wellhead housing 17. As shown in FIGS. 6A and 6B, retrieval tool 71 has a body 73 that is adapted to land on the rim of inner wellhead housing 17 (FIG. 7). A stem 75 extends upward from body 73 for connection to a string of drill pipe. A locking member 77, identical to locking member 33, is mounted below body 73. Locking member 77 has dogs 79 which will engage a grooved profile within inner wellhead housing 17 (FIG. 7). A cam sleeve 81 pushes dogs 79 to the extended position. Cam sleeve 81 is threaded and moves axially in response to rotation of stem 75 relative to body 73.

A downward opening funnel 83 is mounted to body 73 for sliding over the exterior of inner wellhead housing 17. A frame 85 is carried by body 73 and is axially movable relative to body 73. Frame 85 has a piston 87 that slides against a neck 88 protruding upward from body 73. Chambers are formed above and below piston 87. A port 89 allows the injection of hydraulic fluid from a remote operated vehicle ("ROV") to push piston 87 and frame 85 downward. Another port 91 allows the return of hydraulic fluid in the downstroke. Similarly, hydraulic fluid is injected into port 91 and returned through port 89 to pump frame 85 upward.

Figure 9:
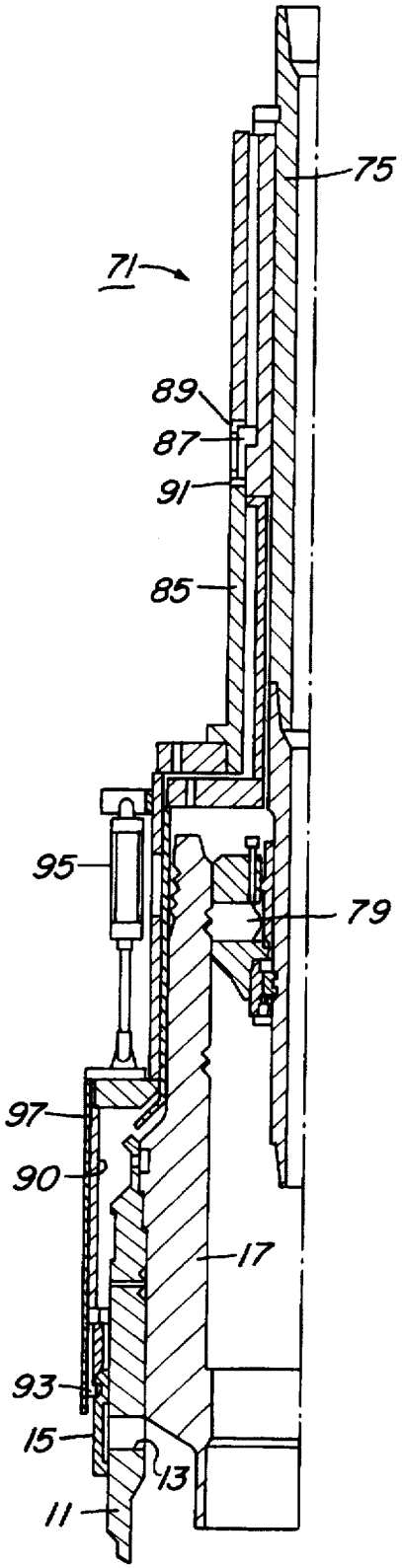
FIG. 9 is a quarter sectional view of the retrieval tool of FIG. 6, shown with the locking sleeve moved down to lock the engaging member to the valve sleeve.
Figure 10:
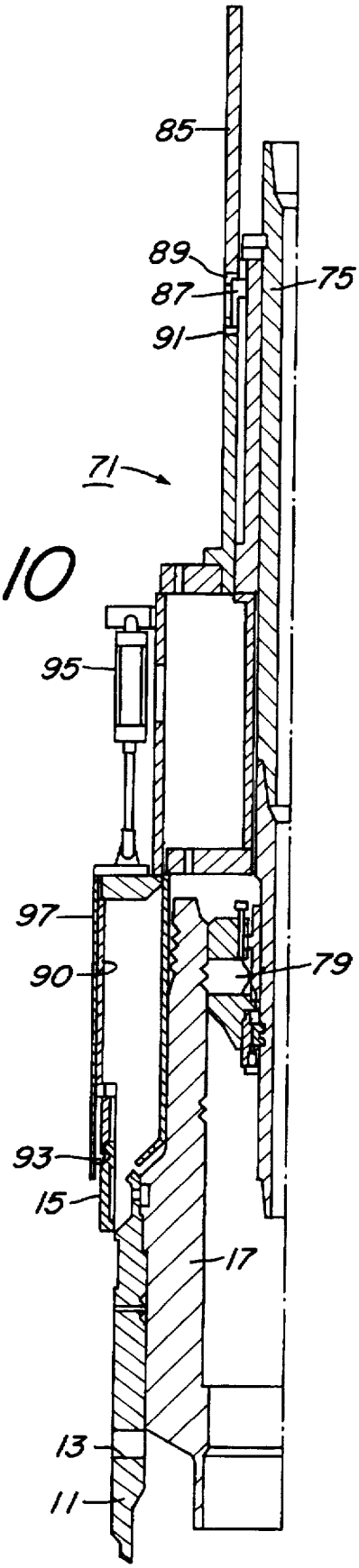
FIG. 10 is a quarter sectional view of the retrieval tool of FIG. 6, shown lifting the valve sleeve from the outer wellhead housing.

An engaging sleeve 90 extends downward from frame 85 for sliding over the exterior of outer wellhead housing 11 (FIG. 7). Engaging sleeve 90 has a base 92, which is a cylinder of greater thickness than engaging sleeve 90 and which is welded to the lower end of engaging sleeve 90. Base 92 has an inward extending rib **92*a* located at the junction with engaging sleeve 90. A plurality of windows are formed in and spaced around rib 92*a*. A plurality of dogs 93 are located at the lower end of engaging member 90. Each of the dogs 93 has a lower end 93*a* that is biased outward, but which will engage groove 18 formed on valve sleeve 15 (FIGS. 2B and 7) when forced inward. Each of the dogs 93 has an upper end 93*b* that extends into one of the windows in rib 92*a*. The lower ends 93*a* of dogs 93 are forced radially inward by a hydraulic cylinder 95 which strokes a cam sleeve 97 from an upper to a lower position. When cam sleeve 97 moves downward, it forces the lower ends 93*a* of dogs 93 inward into engagement with groove 18 as shown in FIG. 9. Dogs 93 will lock valve sleeve 15 to engaging sleeve 90**.

In the operation of retrieval tool 71, valve sleeve 15 has been previously moved to the closed position and inner wellhead housing 17 installed. At some later date, for maintenance or otherwise, the operator uses retrieval tool 71 to retrieve valve sleeve 15 to the surface for repair or replacement. The operator will lower retrieval tool 71 on a string of drill pipe. Funnel 83 slides over inner wellhead housing 17, as shown in FIG. 7. The operator rotates the drill pipe relative to body 73 to extend dogs 79 to the locked position shown in FIG. 7. Engaging sleeve 90 will still be in the upper position at this point.

Figure 8:
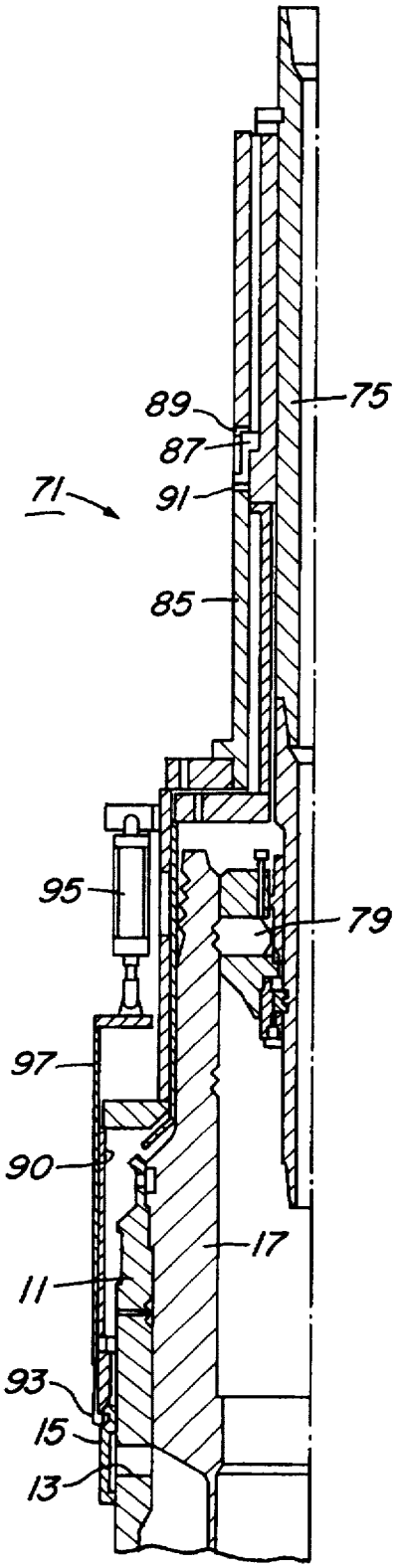
FIG. 8 is a quarter sectional view of the retrieval tool of FIG. 6, shown engaging the valve sleeve.

The operator lowers an ROV (not shown) to apply hydraulic fluid pressure to upper port 89. This pushes piston 87 downward, along with frame 85 and engaging sleeve 90. Dogs 93 will slide over neck 16 (FIG. 2B) of valve sleeve 15 as shown in FIG. 8. The operator then uses the ROV to supply hydraulic fluid pressure to hydraulic cylinder 95, moving cam sleeve 97 downward over dogs 93. Dogs 93 move into locking engagement with groove 18 of valve sleeve 15.

The operator then moves the ROV to injection port 91 and supplies hydraulic fluid to the lower side of piston 87. This retracts engaging sleeve 90 to the position shown in FIG. 10. The operator then rotates the drill pipe to release locking member 77 from inner wellhead housing 15. The operator retrieves retrieval tool 71. At the surface, the operator will repair or replace valve sleeve 15 and reinstall it with running tool 71. While reinstalling it, the process described above will be repeated but in reverse.

The invention has significant advantages. The running tool can both run and preload inner wellhead housing in outer wellhead housing, as well as shift an external valve sleeve. The retrieval tool can both retrieve as well as run a valve sleeve.

While the invention is shown in only two of its forms, it should be apparent to those skilled in the art that it is not so limited but is susceptible to various changes without departing from the scope of the invention.

We claim:

1. A tool for moving an external valve sleeve on a subsea outer wellhead housing between open and closed positions, the outer wellhead housing having an inner wellhead housing installed therein, the tool comprising in combination:

a body adapted to be connected to a string of conduit for lowering the body from a drilling vessel;

a support mechanism carried by the body having an engaged position for engaging the inner wellhead housing and a released position for releasing engagement with the inner wellhead housing;

an engaging member carried by the body for axial movement relative to the body between upper and lower positions, the engaging member adapted to slide over the outer wellhead housing into engagement with the valve sleeve; and an actuator mounted to the body and the engaging member for causing the engaging member to move to the lower position to engage the valve sleeve to enable the valve sleeve to be moved from one of the positions to another of the positions.

2. The tool according to claim 1 wherein the support mechanism is movable to the engaged position prior to installing the inner wellhead housing in the outer wellhead housing, and the tool further comprises in combination:

means for installing the inner wellhead housing in the outer wellhead housing prior to the actuator causing the engaging member to move to the lower position.

3. The tool according to claim 1, further comprising:

a downward opening funnel mounted to the tool for guiding the tool over the inner wellhead housing after it has been installed in the outer wellhead housing; and wherein the support mechanism is moved to the engaged position after the tool has landed on the inner wellhead housing.

4. The tool according to claim 1, further comprising:

a downward opening funnel mounted to the tool for guiding the tool over the inner wellhead housing after it has been installed in the outer wellhead housing; and a latch mounted to the engaging member for latching the engaging member to the valve sleeve, allowing the valve sleeve to be retrieved along with the tool for subsequent repair or replacement.

5. A running tool for installing a subsea inner wellhead housing in a subsea outer wellhead housing and for moving a valve sleeve on the outer wellhead housing to a closed position blocking a flow port, comprising in combination:

a body adapted to be connected to a string of conduit for lowering the body from a drilling vessel onto the outer wellhead housing;

support means carried by the body having an engaged position for engaging the inner wellhead housing to land the inner wellhead housing in the outer wellhead housing and a released position for releasing engagement with the inner wellhead housing after the inner wellhead housing has been installed in the outer wellhead housing;

an engaging member carried by the body for axial movement relative to the body between upper and lower positions, the engaging member adapted to slide over the outer wellhead housing when the inner wellhead housing initially lands in the outer wellhead housing; and actuating means for retaining the engaging member in an upper position relative to the body when the inner wellhead housing initially lands in the outer wellhead housing, and for causing the engaging member to move to the lower position for moving the valve sleeve downward to the closed position.

6. The running tool according to claim 5, wherein the actuating means is prevented from moving the engaging member to the lower position until the support means is in the released position and the body is picked up a selected distance relative to the outer wellhead housing.

7. The running tool according to claim 5 wherein the actuating means comprises:

first latch means for locking the engaging member in the upper position and for releasing the engaging member from the upper position after the support means moves to the released position, allowing the body to be moved upward relative to the engaging member; and second latch means for locking the engaging member in the lower position once the body moves a selected distance upward relative to engaging member, allowing the body to be lowered again in unison with the engaging member, with the weight of the body and the string of conduit forcing the valve sleeve downward to the closed position.

8. The running tool according to claim 5, further comprising:

a reacting sleeve carried by the body for sliding over the outer wellhead housing and for axial movment relative to the body;

gripping means on the reacting sleeve for gripping the outer wellhead housing as the inner wellhead housing initially lands within the outer wellhead housing;

means for forcing the body and inner wellhead housing downward relative to the reacting sleeve after the gripping means has gripped the outer wellhead housing to move the inner wellhead housing from an initial landing position to an installed position; and wherein the engaging member is carried on the exterior of the reacting sleeve.

9. The running tool according to claim 5, further comprising:

a reacting sleeve carried by the body within the engaging member for sliding over the outer wellhead housing and for axial movment relative to the body and inner wellhead housing;

gripping means on the reacting sleeve having a gripping position for gripping the outer wellhead housing as the inner wellhead housing initially lands within the outer wellhead housing and a released position for releasing the reacting sleeve from the outer wellhead housing;

means for forcing the body and inner wellhead housing downward relative to the reacting sleeve after the gripping means has gripped the outer wellhead housing to move the inner wellhead housing from an initial landing position to an installed position;

first latch means for locking the engaging member to the reacting sleeve in the upper position and for releasing the engaging member from the upper position after the gripping means and support means have moved to the released position, allowing the body and reacting sleeve to be moved upward relative to the engaging member; and second latch means for locking the engaging member to the reacting sleeve in the lower position once the body and reacting sleeve move a selected distance upward relative to the engaging member, allowing the body to be lowered again in unison with the engaging member, with the weight of the body and the string of conduit forcing the valve sleeve downward to the closed position.

10. A running tool for installing a subsea inner wellhead housing in a subsea outer wellhead housing and for moving a valve sleeve on the outer wellhead housing to a closed position blocking a flow port, comprising in combination:

a body adapted to be connected to a string of conduit for lowering the body from a drilling vessel onto the outer wellhead housing;

support means carried by the body having an engaged position for engaging the inner wellhead housing to land the inner wellhead housing in the outer wellhead housing and a released position for releasing engagement with the inner wellhead housing after the inner wellhead housing has been installed in the outer wellhead housing;

a reacting sleeve carried by the body for sliding over the outer wellhead housing and for axial movment relative to the body and the inner wellhead housing;

gripping means on the reacting sleeve having a gripping position for gripping the outer wellhead housing as the inner wellhead housing initially lands within the outer wellhead housing and a released position for releasing the reacting sleeve from the outer wellhead housing after the inner wellhead housing has been installed in the outer wellhead housing;

means for forcing the body and inner wellhead housing downward relative to reacting sleeve after the gripping means has gripped the outer wellhead housing to move the inner wellhead housing from an initial landing position to an installed position;

an engaging member carried by the reacting sleeve for axial movement relative to the reacting sleeve between upper and lower positions, the engaging member adapted to slide over the outer wellhead housing when the inner wellhead housing initially lands in the outer wellhead housing; and actuating means for retaining the actuating member in an upper position when the gripping means initially grips the outer wellhead housing, and for causing the engaging member to move to the lower position for engaging and moving the valve sleeve downward after the inner wellhead housing has been installed in the outer wellhead housing.

11. The running tool according to claim 10, wherein the actuating means is prevented from causing the engaging member to move to the lower position until the support means and gripping means are in the released positions and the body is picked up a selected distance relative to the outer wellhead housing.

12. The running tool according to claim 10 wherein the actuating means comprises:

first latch means for locking the engaging member to the reacting sleeve in the upper position and for releasing the engaging member from the upper position in response to movement of the gripping means to the released position, allowing the body and reacting sleeve to be moved upward relative to the engaging member; and second latch means for locking the engaging member in the lower position once the body and reacting sleeve move a selected distance upward relative to engaging member, allowing the body and reacting sleeve to be lowered again in unison with the engaging member, with the weight of the string of conduit forcing the valve sleeve downward to the closed position.

13. A tool for retrieving and installing a valve sleeve mounted to the exterior of a subsea outer wellhead housing which has an inner wellhead housing installed within and protruding above the outer wellhead housing, comprising:

a body adapted to be connected to a string of conduit for lowering the body from a drilling vessel onto the outer wellhead housing;

a downward opening funnel mounted to the body for guiding the tool over the inner wellhead housing;

a support mechanism carried by the body for engaging the inner wellhead housing;

an engaging member carried by the body for axial movement relative to the support mechanism;

a latch on the engaging member for latching the engaging member to the valve sleeve; and means for moving the engaging member downward after the support mechanism has engaged the inner wellhead housing, causing the latch to latch the engaging member to the valve sleeve, allowing the valve sleeve to be retrieved along with the tool.

14. The tool according to claim 13, further comprising:

a frame mounted to the body for axial movement relative thereto, the engaging member being mounted to the frame for axial movement in unison; and wherein the means for moving the engaging member downward comprises:

a piston and cylinder mounted between the body and the frame for moving the frame between upper and lower positions relative to the body.

15. A method for moving an external valve sleeve on a subsea outer wellhead housing between open and closed positions, the outer wellhead housing having an inner wellhead housing installed therein, the method comprising:

mounting an engaging member to a body for axial movement relative to the body between upper and lower positions;

securing the body to a string of conduit and lowering the body from a drilling vessel;

releasably engaging the body with the inner wellhead housing;

sliding the engaging member over the outer wellhead housing; then causing the engaging member to move to the lower position into engagement with the valve sleeve; then moving the valve sleeve from one of the positions to another of the positions.

16. The method according to claim 15, wherein the step of engaging the body with the inner wellhead housing occurs at the drilling vessel; and wherein the method further comprises:

lowering the inner wellhead housing with the body and installing the inner wellhead housing in the outer wellhead housing before causing the engaging member to move to the lower position.

17. The method according to claim 15, wherein the step of engaging the body with the inner wellhead housing occurs subsea, the inner wellhead housing having been previously installed in the outer wellhead housing.

18. The method according to claim 15, further comprising:

latching the engaging member to the valve sleeve while the engaging member is in the lower position; and retrieving the valve sleeve along with the engaging member.

19. A method for installing a subsea inner wellhead housing in a subsea outer wellhead housing and moving a valve sleeve on the outer wellhead housing to a closed position blocking a flow port, comprising in combination:

(a) mounting an engaging member to a body for axial movement relative to the body between upper and lower positions;

(b) securing the body to the inner wellhead housing at a drilling vessel;

(c) connecting the body to a string of conduit and lowering the inner wellhead housing from the drilling vessel into the outer wellhead housing;

(d) sliding the engaging member over the outer wellhead housing while the inner wellhead housing is landing in the outer wellhead housing and while the engaging member is in the upper position; then (e) moving the engaging member to the lower position, contacting the valve sleeve and moving the valve sleeve downward to the closed position.

20. The method according to claim 19, wherein step (e) comprises:

after step (d), releasing the engagement of the body with the inner wellhead housing and picking up the body a selected distance relative to the engaging member to place the engaging member in the lower position; then locking the engaging member in the lower position; then lowering the body again while the engaging member is in the lower position to push the valve sleeve downward.

* * * * *